US005920966A

United States Patent [19]

Chen

[11] Patent Number: 5,920,966

[45] Date of Patent: Jul. 13, 1999

[54] MAGNETIC FASTENER

[76] Inventor: Chi-Yueh Chen, 20-3 FL # 88 An-Ho Road Sec. 2, Taipei, Taiwan

[21] Appl. No.: 08/794,237

[22] Filed: Jan. 31, 1997

Related U.S. Application Data

[63] Continuation of application No. 08/677,940, Jul. 10, 1996, Pat. No. 5,675,874.

[60] Provisional application No. 60/011,847, Feb. 16, 1996.

[51] Int. Cl.[6] ..... A44B 21/00

[52] U.S. Cl. ..... 24/303

[58] Field of Search ..... 335/285, 303, 335/304; 24/303, 66.1; 292/251.5; 248/206.5

[56] References Cited

U.S. PATENT DOCUMENTS

| | | |
|---|---|---|
| D. 303,641 | 9/1989 | Aoki . |
| D. 319,201 | 8/1991 | Aoki . |
| 2,288,688 | 7/1942 | Dubilier . |
| 2,702,683 | 2/1955 | Green et al. . |
| 2,806,396 | 9/1957 | Miller . |
| 2,812,203 | 11/1957 | Scholten . |
| 2,884,508 | 4/1959 | Czipott et al. . |
| 2,975,497 | 3/1961 | Budreck . |
| 3,009,225 | 11/1961 | Budreck . |
| 3,372,443 | 3/1968 | Daddona, Jr. . |
| 3,618,174 | 11/1971 | Schainholz et al. . |
| 3,919,743 | 11/1975 | Cutler . |
| 4,021,891 | 5/1977 | Morita . |
| 4,231,137 | 11/1980 | Fujimoto . |
| 4,265,002 | 5/1981 | Hosken . |
| 4,453,294 | 6/1984 | Morita . |
| 4,455,719 | 6/1984 | Morita . |
| 4,458,395 | 7/1984 | Aoki . |
| 4,458,396 | 7/1984 | Aoki . |
| 4,480,361 | 11/1984 | Morita . |
| 4,700,436 | 10/1987 | Morita . |
| 4,754,532 | 7/1988 | Thomson et al. . |
| 4,779,314 | 10/1988 | Aoki . |
| 4,825,526 | 5/1989 | Shenier et al. . |
| 4,941,235 | 7/1990 | Aoki . |
| 4,989,299 | 2/1991 | Morita . |
| 4,991,270 | 2/1991 | Aoki . |
| 5,010,622 | 4/1991 | Morita . |
| 5,042,116 | 8/1991 | Ossiani . |
| 5,125,134 | 6/1992 | Morita . |

(List continued on next page.)

FOREIGN PATENT DOCUMENTS

| | | | |
|---|---|---|---|
| 1127509 | 4/1962 | Germany . | |
| 3902289 | 8/1989 | Germany . | |
| 58-105508 | 6/1983 | Japan . | |
| 58-105513 | 6/1983 | Japan | 335/285 |
| 58-121610 | 7/1983 | Japan . | |
| 59-111306 | 6/1984 | Japan . | |
| 61-93606 | 5/1986 | Japan . | |
| 61-141101 | 6/1986 | Japan . | |
| 61-219111 | 9/1986 | Japan . | |
| 61-251008 | 11/1986 | Japan . | |
| 61-258406 | 11/1986 | Japan . | |
| 1519246 | 7/1978 | United Kingdom . | |
| 2252593 | 8/1982 | United Kingdom . | |
| 2095321 | 9/1982 | United Kingdom . | |

*Primary Examiner*—James R. Brittain
*Attorney, Agent, or Firm*—Dilworth & Barrese

[57] ABSTRACT

A magnetic closure device is disclosed, having a magnetically attractive first element including a cylindrical shaped magnet defining an axial bore and having first and second axial ends with first and second opposite polarities respectively, and an annular cover member covering the first axial end of the cylindrical magnet. First element further includes a ferromagnetic plate having a portion adjacent the second axial end of the cylindrical magnet and a generally cylindrical wall portion disposed around the cylindrical shaped magnet and radially spaced a predetermined lateral distance therefrom. The cylindrical wall is connected to the annular cover member. A ferromagnetic rod extends from the ferromagnetic plate into the axial bore of the cylindrical magnet. A magnetically attractable second element is disclosed which is positionable adjacent the annular cover member.

12 Claims, 7 Drawing Sheets

U.S. PATENT DOCUMENTS

| | | | |
|---|---|---|---|
| 5,142,746 | 9/1992 | Morita . | |
| 5,208,951 | 5/1993 | Aoki . | |
| 5,249,338 | 10/1993 | Aoki . | |
| 5,251,362 | 10/1993 | Riceman et al. . | |
| 5,274,889 | 1/1994 | Morita . | |
| 5,379,495 | 1/1995 | Riceman et al. . | |
| 5,400,479 | 3/1995 | Medina et al. . | |
| 5,448,806 | 9/1995 | Riceman et al. . | |
| 5,473,799 | 12/1995 | Aoki . | |
| 5,560,089 | 10/1996 | Morita | 24/303 |
| 5,647,101 | 7/1997 | Morita | 24/303 |

200

150
176
184a
160
140
164
124
236
248
249
208
210
211
246
206
114
118a
120
N
S

MAGNETIC FASTENER

CROSS-REFERENCE TO RELATED APPLICATIONS

This is a continuation of copending application Ser. No. 08/677,940 filed Jul. 10, 1996 now U.S. Pat. No. 5,675,874.

This application claims the benefit under 35 U.S.C. §119 (e) of U.S. Provisional Application No. 60/011,847 filed on Feb. 16, 1996.

BACKGROUND

1. Technical Field

The present disclosure relates to magnetic fasteners, and more particularly to a magnetic fastener which is configured to contain the magnetic field and reduce leakage thereof.

2. Background of the Related Art

There have been many attempts to develop a commercially successful magnetic fastener for use in various applications such as for handbag closures. Included among these attempts are U.S. Pat. Nos. 2,812,203, 2,884,508, 3,372,443, 3,618,174, 3,919,743, 4,455,719, 4,458,396, 4,231,137, 4,754,532, 4,825,526, 4,021,891, 4,700,436, 4,453,294, 5,042,116, 5,142,746, 5,274,889, 5,251,362, 5,400,479 and 5,379,495.

For convenience of explanation of prior art fasteners, such fasteners are illustrated generally in FIG. 1 to which reference is being made. One disadvantage of presently known fasteners is that they fail to effectively contain the leakage of lines of magnetic flux both when the fastener is open as well as after the fastener is in the closed position. For example, referring to FIG. 1, for a magnetic fastener 10 manufactured as described in certain of the above listed patents, substantial magnetic flux leakage 12 radiates in all directions from magnet 14 with the primary leakage being laterally or radially around the perimeter of the magnetic fastener 10. This radial leakage occurs because there is no provision to contain magnetic flux lines 12 in a closed path around the periphery of fastener 10 and thus the lines of flux 12 extend out and around to the back of both the male plates 16 and female plates 18. Such leakage may cause damage to devices such as credit cards, computer disks and other items which store information or magnetic media.

Second, the above referenced fasteners depend primarily upon magnetic attraction to keep their parts in the closed position while using other means to prevent lateral movement and thus disengagement. The problem of lateral movement in all of the above fasteners is in part solved by the placement of pin 20 or other protrusion on at least one of the parts which fits into a receiving hole 22 defined in the other part 18 (FIG. 1). However, this configuration is not sufficiently effective when a lateral force is applied to the two parts of the fasteners, and the pin is moved off center relative to the corresponding pin on the second part of the fastener. This misalignment weakens the magnetic connection between the two parts. U.S. Pat. No. 5,042,116 to Ossianni attempts to stop this movement with a counter-sinking pin which fits snugly into a recess in the opposing pin. This arrangement requires difficult and costly manufacturing of the pins. Even the smallest amount of dust or magnetically attractive sand in the receiving recess will prevent the pin from seating properly, which weakens the magnetic circuit and thus the holding power of the fastener.

Magnetic fasteners, such as those described in the above patents, are primarily used on items such as handbags, which presents additional design problems. For example, at least one part of the fastener is affixed to a somewhat flexible member, such as the flap of the bag. This further decreases the holding strength of the fastener when a lateral separating force is applied to such fastener. Upon such application of lateral force to the fastener as described, the fastener rotates on its own axis until the attractive force of the magnet is no longer perpendicular to the long axis of the pin, which is oriented at a right angle to the face of the magnet. Because the magnetic attracting force is centered through the pin and at a right angle to the face of the magnet, when this rotation occurs, less force is required to disengage the two parts.

Further, when lateral force is applied to the currently available commercially successful magnetic fasteners, the pin may slide to the side of the hole and ride up and over the rim of the hole. This movement changes the direction of resistance from a line perpendicular to the face of the magnet (the angle of the greatest resistance to separation) to an arc or angle of less than 90° to the face of the magnet (a direction of lessened resistance to separation).

The present invention relates to a magnetic fastener which avoids the above described problems by encapsulating the lines of magnetic flux which radiate from the magnet. The fastener also incorporates further mechanical attachment to augment the magnetic attraction of the magnetic fastener.

SUMMARY

The present invention is directed to a unique magnetic fastener having a magnetically attractive first element and a magnetically attractable second element. First element includes a cylindrical shaped magnet defining an axial bore and having first and second axial ends with first and second opposite polarities, respectively. An annular cover member is provided which covers the first axial end of the cylindrical magnet. First element further includes a ferromagnetic plate having a portion adjacent the second axial end of the cylindrical magnet and a generally cylindrical wall portion disposed around the cylindrical shaped magnet and radially spaced a predetermined lateral distance therefrom. The cylindrical wall is preferably monolithically formed with the ferromagnetic plate. The cylindrical wall is connected to the annular cover member, and may have a thickness substantially greater than the thickness of the annular cover member. A ferromagnetic rod extends from the ferromagnetic plate into the axial bore of the cylindrical magnet. The second element is positionable adjacent the annular cover member.

Annular cover member includes an aperture fixedly aligned with the axial bore and of a lesser dimension than the axial bore so as to define a rim portion extending into the area defined by the axial bore. The second element includes a protrusion having a peripheral recess therein which defines a peripheral undercut thereon adjacent the rim portion. The protrusion is positionable within the axial bore movable laterally therein such that the rim portion is engaged with the undercut to provide mechanical interference to prevent accidental separation of the first and second elements by simultaneous lateral and axial movement of one from the other.

These and other features of the magnetic fastener will become more readily apparent to those skilled in the art from the following detailed description of preferred embodiments of the subject disclosure.

BRIEF DESCRIPTION OF THE DRAWINGS

Various embodiments of the surgical magnetic fastener are described herein with reference to the drawings wherein.

DETAILED DESCRIPTION OF PREFERRED EMBODIMENTS

Figure 1:
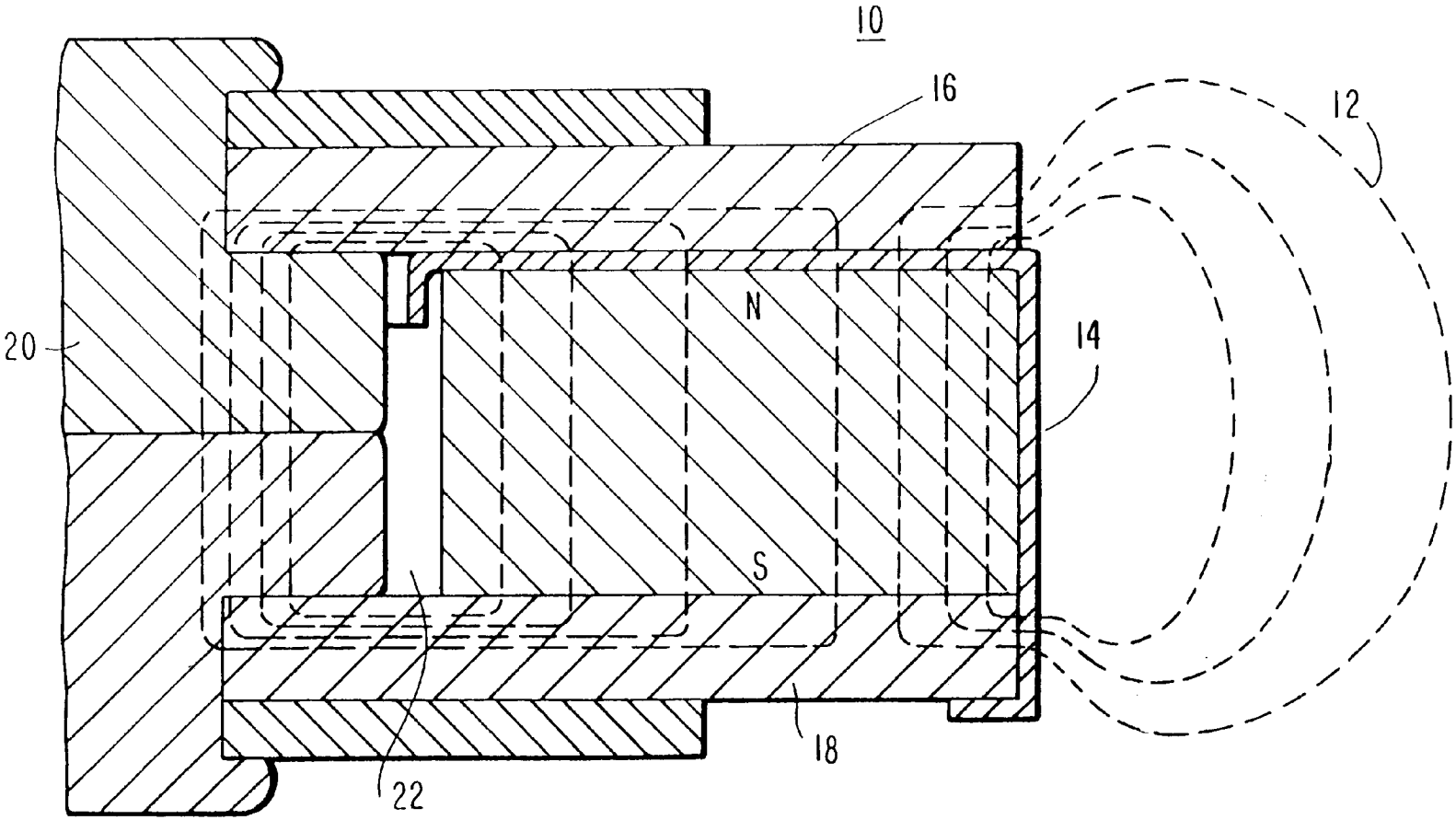
FIG. 1 (PRIOR ART)
FIG. 1 is a cross-sectional view of a representative one-half portion of a magnetic fastener constructed in accordance with the prior art.
Figures 2, 3:
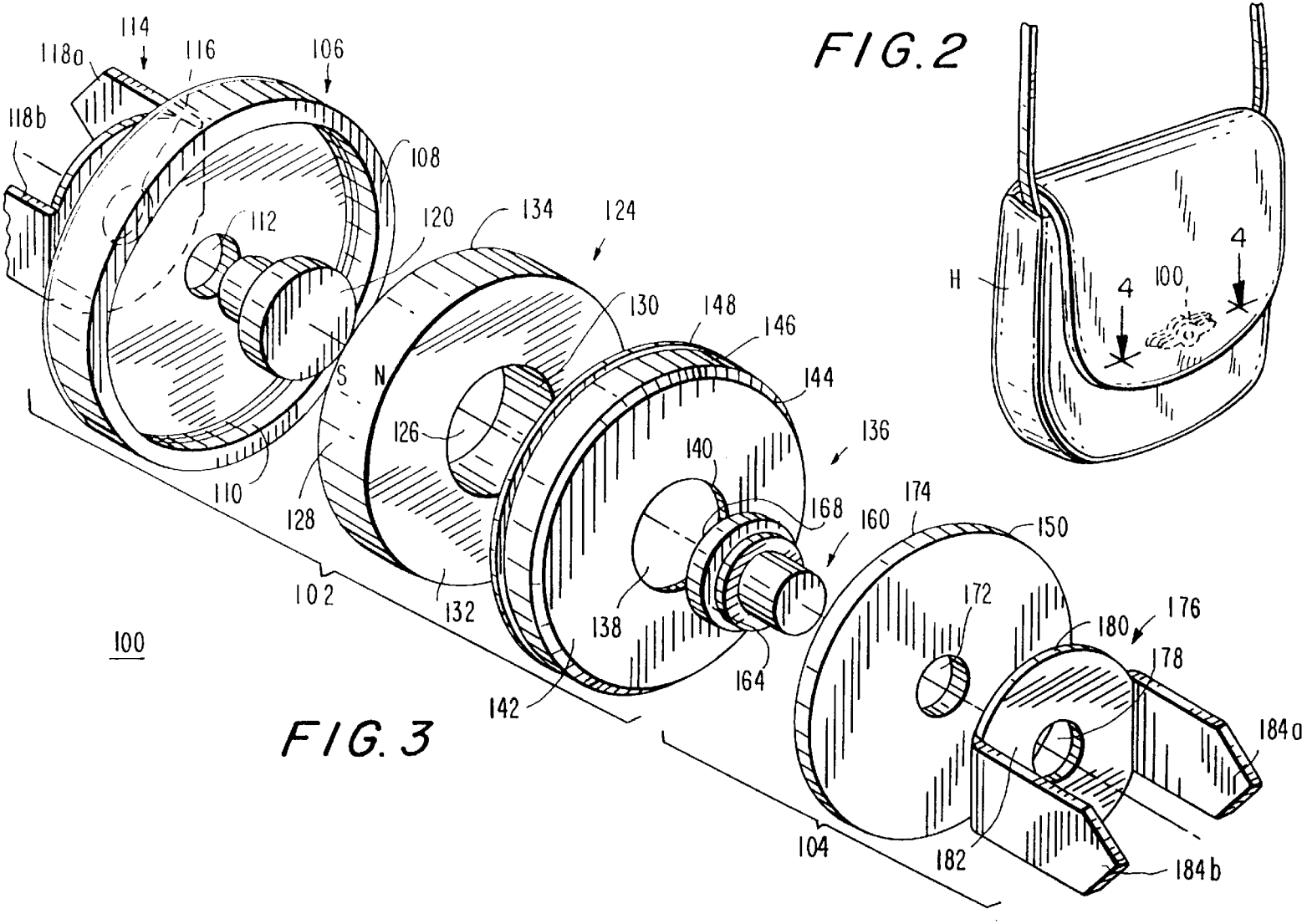
FIG. 2 is a perspective view in reduced scale, of the magnetic fastener constructed in accordance with a preferred embodiment of the subject disclosure, illustrating attachment to a handbag.
FIG. 3 is a perspective view with parts separated of the magnetic fastener of FIG. 2.

Referring now in detail to the drawings in which the reference numerals identify similar or identical elements, a preferred embodiment of the subject invention is illustrated in FIG. 2, and is designated generally by reference numeral 100. Magnetic fastener 100 is typically attached to an item, such as handbag H. Magnetic fastener 100 will have many other applications such as, for use as a closure for jewelry, belts, garments and other items.

As illustrated in FIG. 3, magnetic fastener 100 consists of at least eight major components and makes effective use of more of the available magnetic attraction of the magnet used than any of the fasteners described above. In particular, the present fastener effectively uses and/or controls and encapsulates virtually 100% of the available magnetic flux by generally forcing it into a path which is as close as possible to the surface of the magnet without shorting out the magnetic circuit. Referring again to FIG. 3, magnetic fastener 100 includes magnetically attracting female portion 102, which is preferably attached to one part, e.g. the body, of handbag H, and magnetically attractable male portion 104, which is attached to a second part, e.g. the flap, of handbag H. Female portion 102 includes female base plate 106, which has an annular ring or outer perimeter or cylindrical wall 108, with a toothed, textured or grooved inner surface 110 (See, FIG. 3). Female base plate 106 defines hole 112 extending therethrough. Female prong plate 114 defines hole 116 and has a plurality of attachment protrusions 118*a* and 118*b* for securing female portion 102 to handbag H. Protrusion or rivet 120 extends through hole 112 in base plate 106 and hole 116 in prong plate 114.

Generally cylindrical magnet 124 has at least one axial bore 126 extending from first axial end 132 to second axial end 134. Magnet 124 defines outer peripheral wall 128 and an inner wall 130. Magnet cover member 136 includes a top surface 142 defining a hole 138 extending therethrough, with an edge or rim 140, an angled end wall 144 and a side wall 146. Side wall 146 has a textured, toothed or grooved outer surface 154.

Figure 4:
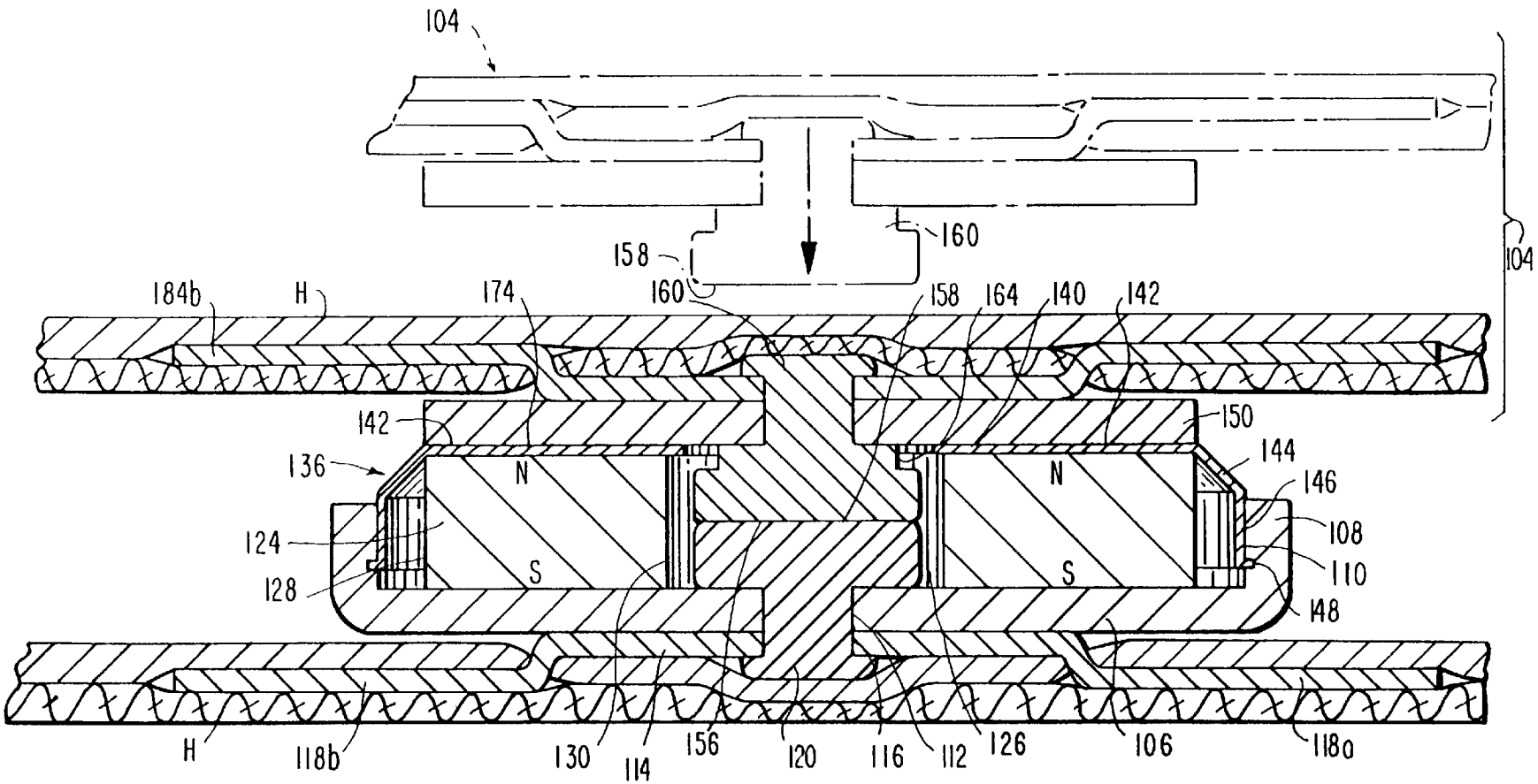
FIG. 4 is a cross-sectional view of the magnetic fastener, illustrating the approximation of the two elements.

With reference to FIG. 4, cylindrical wall 108 extends in an upward direction from base plate 106 and is monolithically fabricated therefrom as a single component. Cylindrical wall 108 is formed at essentially a right angle to plate 106 and is of sufficient height as to bring its upper edge adjacent, but not into contact with male base plate 150. Cylindrical wall 108 is preferably two millimeters in height. Cylindrical wall 108 may have an uneven, notched, or textured upper edge. Hole 112 in base plate 106 receives protrusion or rivet 120, which is used to hold prong plate 114 and base plate 106 together.

Cylindrical wall 108 has a textured, toothed and/or grooved inner surface 110, which surface cooperates with a mating surface 154 located on the outer surface of magnet cover 136 (FIG. 4). By "textured surface" is meant that one surface is roughened either randomly or by formation of parallel step-like grooves, which mate with an opposed surface which is correspondingly roughened or grooved in a similar fashion. One such example of a grooved "textured" surface will be described below in connection with FIG. 6. Through such texturing, surfaces 110 and 154 thereby cooperate by interference fit and/or friction-like action to hold cover 136, base plate 106 and magnet 124 together upon assembly, as well as in place in their proper spaced relationship relative to one another.

Female prong plate 114 defines hole 116 extending therethrough for receiving protrusion or rivet 120. Prong plate 114 has at least two prongs 118*a* and 118*b* or other protrusions extending therefrom for use in attaching female portion 102 of the fastener 10 to an item such as handbag H.

Protrusion or rivet 120 is fabricated from a ferromagnetic material and has a top surface 156 which comes into contact with a matching end surface 158 located on protrusion or rivet 160 disposed on male portion 104 when the male portion 104 and female portion 102 of magnetic fastener 10 are brought together into the closed position. Male portion 104 is illustrated in FIG. 4 in phantom lines in a spaced apart position with respect to female portion 102.

Referring again to FIG. 3, magnet 124 provides the magnetic attractive force for fastener 100. Magnet 124 has axial bore 126 which is larger in diameter than protrusion or rivet 120. Axial bore 126 in magnet 124 has an inner wall 130, an outer wall 128 and two opposing axial ends 132 and 134. First axial end 132 and second axial end 134 have opposite magnetic polarity.

Cover plate 136 is preferably made of a non-magnetic material, such as brass or molded plastic, and is fabricated with a generally annular configuration. Hole 138 in cover plate 136 receives said protrusion or rivet 160. Hole 138 is of lesser dimension than axial bore 126 of magnet 124 so as to define lip or rim 140 around the periphery of hole 138. Rim 140 is of sufficient thickness as to cooperate with peripheral notch or undercut 164 located on rivet 160 of male portion 104, as will be described below. When male portion 104 and female portion 102 are in the closed position such that rivet 160 is disposed in axial bore 126, lip or rim 162 is engaged with notch or undercut 164 to provide a mechanical safety connection between male portion 104 and female portion 102 of fastener 100 when a simultaneous lateral and axial separating force is applied to fastener 100.

Referring again to FIG. 4, angled end wall 144 of cover plate 136 is located at the junction between top plate 142 and side wall 146. Preferably, angled end wall 144 may form an angle of between 3 degrees and 90 degrees with top surface 142 and with first axial end 132 of magnet 124. Angled end wall 144 maintains magnet 124 in proper spaced relationship relative to both the outer wall 128 of magnet 124 and cylindrical wall 108 of base plate 106, as well as maintaining the said magnet 124 in a proper spaced relationship between inner wall 130 of magnet 124 and protrusion or rivet 120.

Side wall 146 of cover plate 136 has a textured, toothed or grooved outer surface 154, which surface cooperates with a mating surface 110 located on the interior of cylindrical wall 108 of base plate 106. The aforementioned cooperation between said mating surfaces 154 and 110 holds cover 136 in place after the assembly of female part 102 fastener 100. Cover plate 136 may be held in place by friction or by an adhesive. Additionally, cover plate 136 may have a sprayed-on or dipped-on color coating or metallic coating.

Male portion 104 consists of at least three components (FIG. 3). Male base plate 150, which defines a through hole 172 for receiving protrusion or rivet 120 and face, or exposed, surface 174. Male prong plate 176, which defines a through hole 178, a front surface 180, a back surface 182 and a plurality of protrusions 184*a* and 184*b*, which are used in attaching male portion 104 of fastener 100 to an item such as handbag H. Protrusion or rivet 160 has contact surface 158 and a notch or undercut 164.

Male base plate 150 has a through hole 172, which is aligned with hole a 178 in prong plate 176. As illustrated in FIG. 4, male base plate 150 and prong plate 176 are held together by rivet 160. Rivet 160 has a notch or undercut portion 164, =which works in conjunction with lip 140 to form a mechanical connection between male portion 104 and female portion 102 of fastener 100 when a lateral force is applied to fastener 100. The mechanical connection also resists the off-center arcing or angular displacement described above. This connection is a safety mechanism and is not the primary means by which fastener 100 is held together.

Contact surface 158 of rivet 160 protrudes away from the face surface 174 of base plate 150 to a sufficient distance so as to insure that when rivets 160 and 120 come into contact, there is maintained at least a minimum gap of 0.005 millimeters between the top surface 142 of magnet cover 136 and the face or exposed surface 174 of base plate 150 to prevent the surface of either male base plate 150 or female base plate 106 from becoming scratched when lateral, side to side movement occurs between the male portion 104 and female portion 102 of fastener 100.

Figure 5:
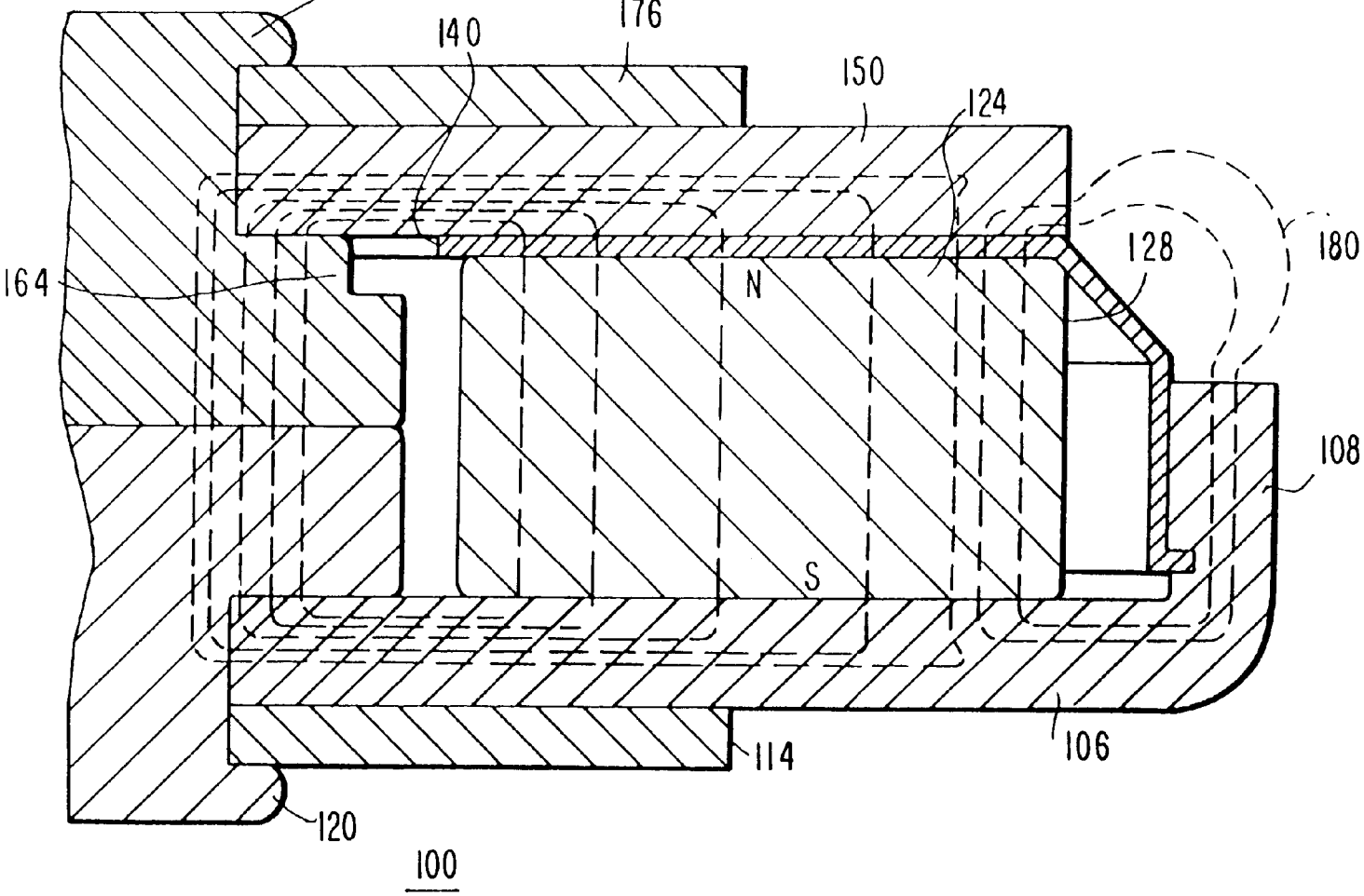
FIG. 5 is an enlarged cross-sectional view of a representative one-half portion of the magnetic fastener of FIG. 2, illustrating the encapsulation of magnetic flux lines.

With reference to FIG. 5, cylindrical wall 108, which is formed monolithically with female base plate 106, extends upward from female base plate 106 toward the edge of male base plate 150. A path is created which effectively contains magnetic flux 180. Cylindrical wall 108 and base plate 106 are fabricated of a ferromagnetic material. By maintaining cylindrical wall 108 at a predetermined radial distance from outside wall 128 of magnet 124, the lines of magnetic flux 180 which radiate out from the side of magnetic fastener 100 are encapsulated, both when fastener 100 is in the closed as well as the open position.

Figure 6:
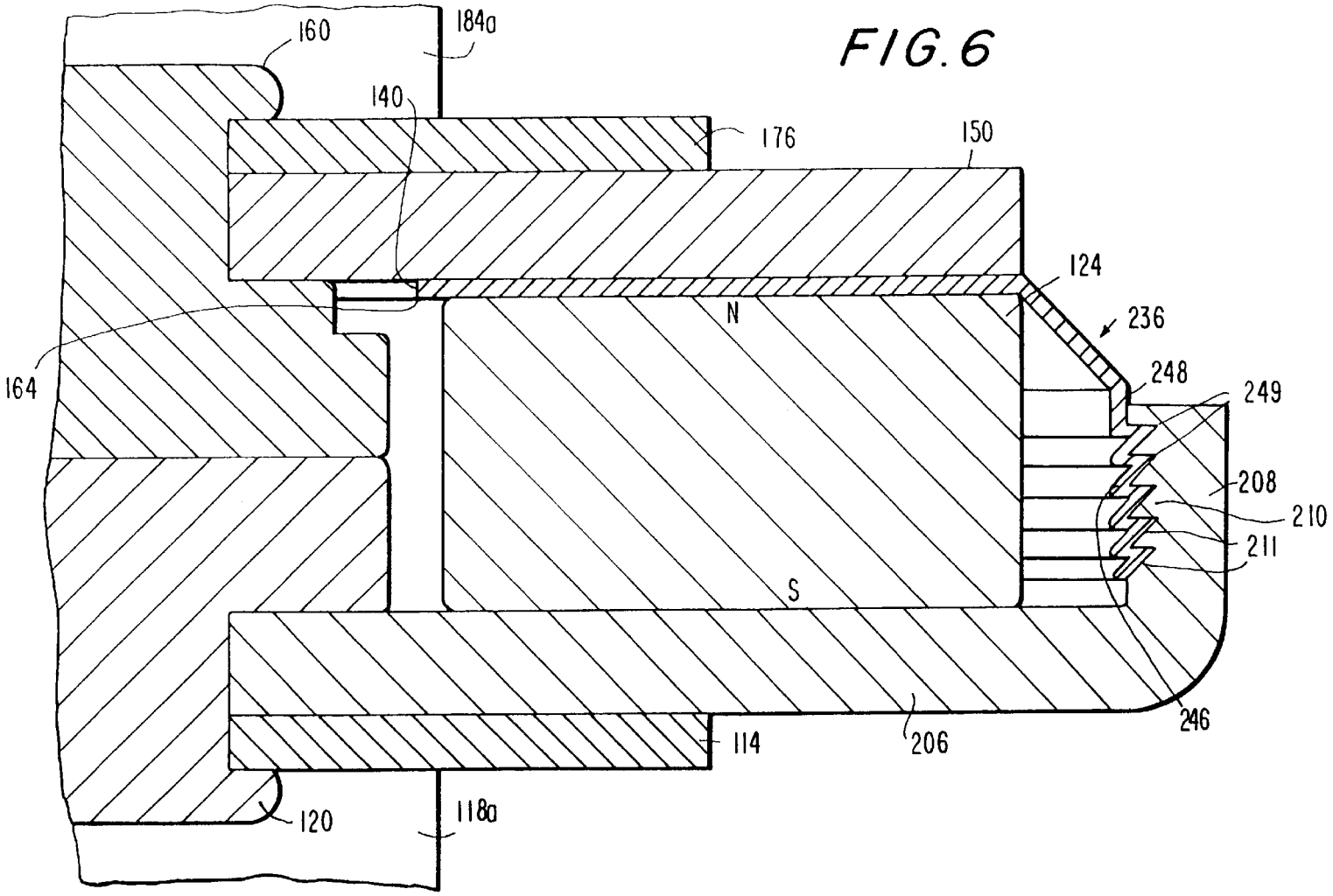
FIG. 6 is an enlarged cross-sectional view of a representative one-half portion of the magnetic fastener, constructed in accordance with a second preferred embodiment of the subject apparatus.

Turning now to FIG. 6, a second preferred embodiment of the magnetic fastener is shown and designated by reference numeral 200. Magnetic fastener 200 is constructed substantially as described above with reference to magnetic fastener 100, with the differences noted below. In particular, cover plate 236 of magnetic fastener 200 is a male member which includes side wall 246, which defines an outer surface 248. Outer surface 248 cooperate with a mating inner surface 210 located on the interior of cylindrical wall 208 of base plate 206. Thus it can be seen that base plate 206 acts as a female member with male member 236. As can be seen in FIG. 6, outer surface 248 of side wall 246 has a textured surface which is greatly enlarged in FIG. 6 and is defined by a plurality of parallel thread-like grooves 249 extending about outer surface 248 which cooperate with complementary thread-like grooves 211 formed on surface 210 of cylindrical wall 208.

Figure 7:
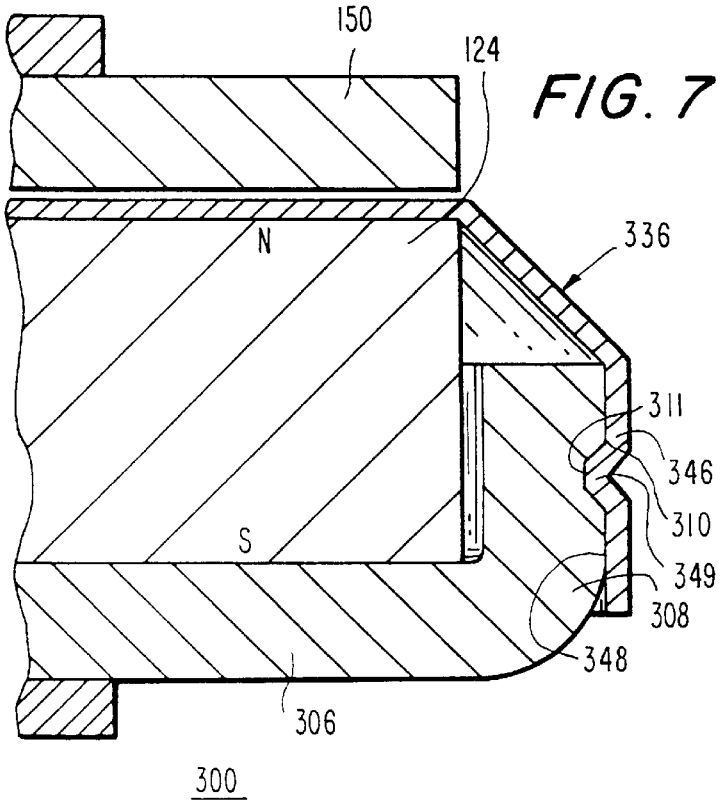
FIG. 7 is a cross-sectional view of a representative portion of the magnetic fastener, constructed in accordance with a third preferred embodiment of the subject apparatus.

FIG. 7 illustrates a third preferred embodiment of the magnetic fastener designated by reference numeral 300. Magnetic fastener 300 is constructed substantially as described above with reference to magnetic fastener 100, with the differences noted below. In particular, cover plate 336 of magnetic fastener 300 includes side wall 346, defining an inner surface 348 which cooperates with a mating outer surface 310 located on the exterior of cylindrical wall 308 of base plate 306. Preferably, cylindrical wall 308 includes a groove 311 which receives an inwardly extending ridge 349 formed on inner surface 348 of side wall 346. It is contemplated that groove 311 and ridge 349 may be interchanged between cylindrical wall 308 and side wall 346, and that other connecting means may be used.

Figure 8:
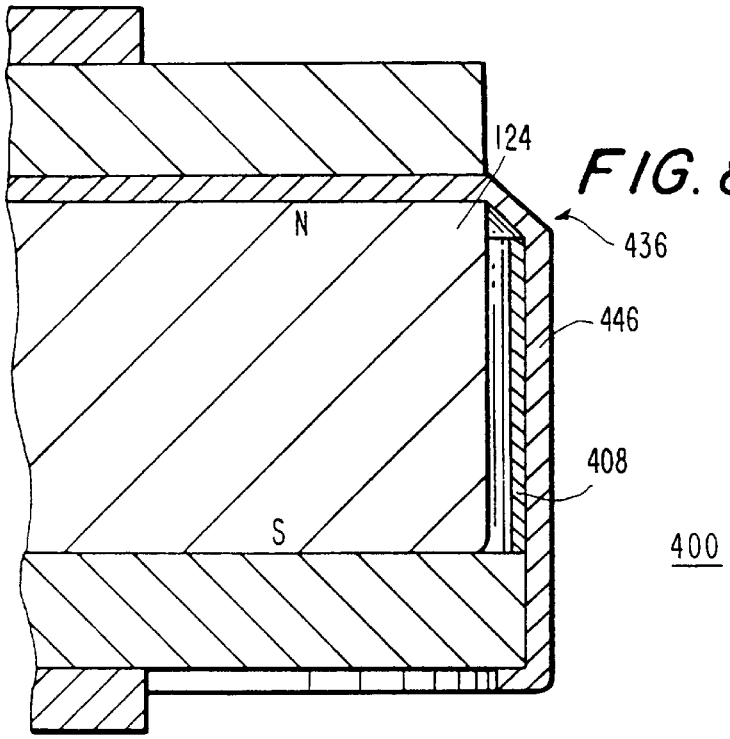
FIG. 8 is a cross-sectional view of a representative portion of the magnetic fastener, constructed in accordance with a fourth preferred embodiment of the subject apparatus.

FIG. 8 illustrates a fourth preferred embodiment of the magnetic fastener designated by reference numeral 400. Magnetic fastener 400 is constructed substantially as described above with reference to magnetic fastener 100, with the differences noted below. Cover plate 436 defines side wall 446 which is spaced a predetermined distance from magnet 124. Encapsulation of magnetic flux is accomplished by cylindrical wall 408, which may be a ferromagnetic coating applied or formed on side wall 446.

Figure 9:
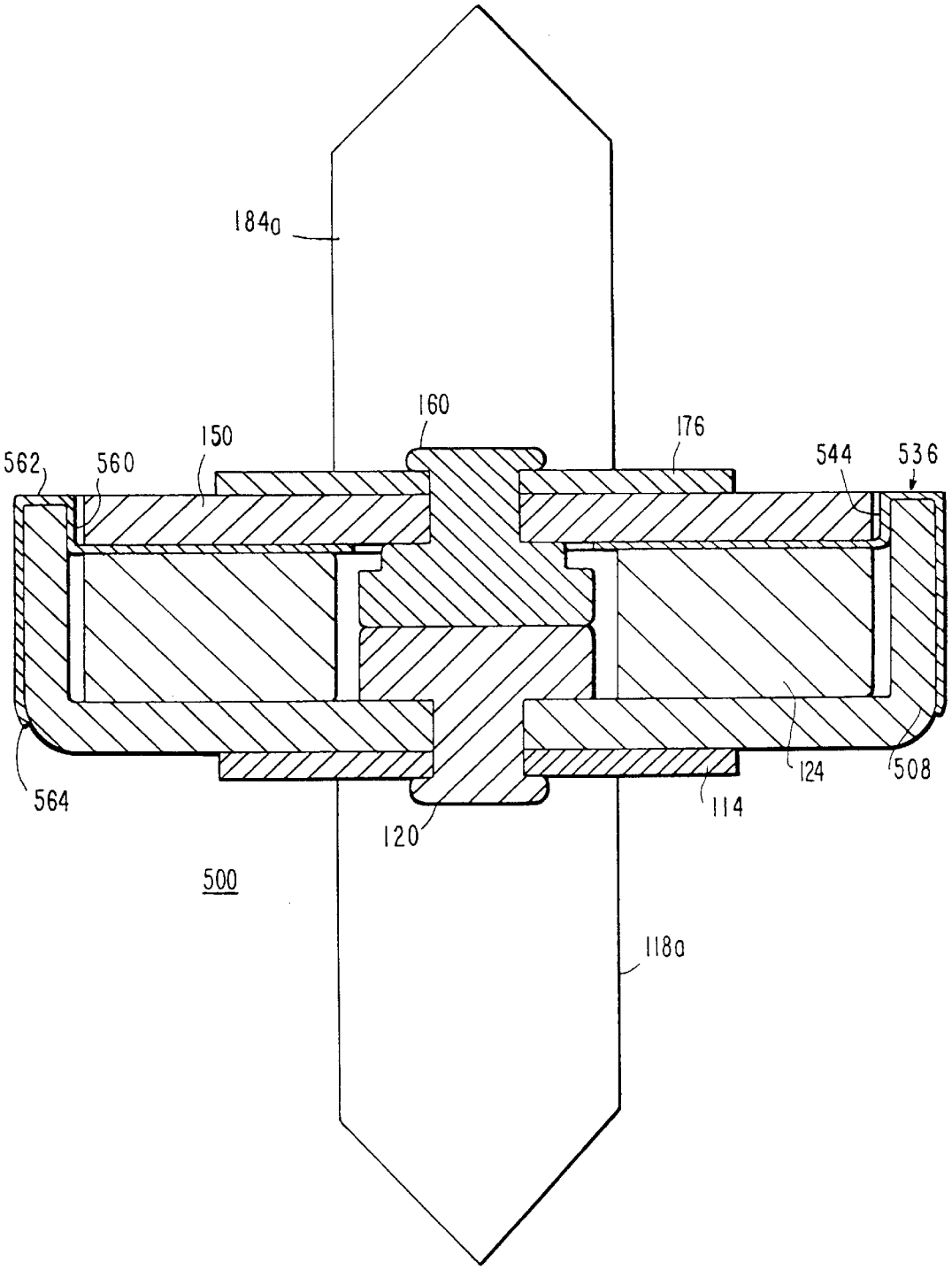
FIG. 9 is a cross-sectional view of the magnetic fastener, constructed in accordance with a fifth preferred embodiment of the subject apparatus.

FIG. 9 illustrates a fifth preferred embodiment of the magnetic fastener designated by reference numeral 500. Magnetic fastener 500 is constructed substantially as described with reference to magnetic fastener 100, with the differences noted below. In particular, cover plate 536 includes angled portion 544 which extends from magnet 124 to cylindrical wall 508, spaced a predetermined distance from magnet 124. Cover plate 536 further includes inner side wall 560 adjacent interior of cylindrical wall 508, upper wall 562 adjacent upper portion of cylindrical wall 508, and outer side wall 564 adjacent exterior of cylindrical wall 508.

The above-described configurations have the following advantages. It provides a balanced mass with an exterior insulating annular wall which effectively guides and encapsulates the magnetic flux radiating from the magnet used. Said flux thus being maintained within the closest possible proximity to the magnet 124 without shorting out the magnetic circuit. This configuration provides far better protection against accidental damage to items such as credit cards and computer disks, caused by the leakage of magnetic flux from the snap, than is afforded by magnetic snaps manufactured according to any of the above mentioned patents.

It provides for the fuller usage of the available magnetic attraction potential of the magnet. This is accomplished by forcing the magnetic flux or forces lines, which in other designs would normally escape and dissipate uselessly from the sides of the snap, into a tight path up the side of the magnet and into the male plate 150.

It provides for superior protection against the unintentional disengagement of the snap parts when lateral force is applied to the closed snap by use of a mechanical safety connection. It is cost-effective to manufacture as the additional safety feature, as well as the exterior magnetic buffer, are achieved without the use of any additional parts. It can be more easily sealed against water and other contaminants because of the tight tolerances involved between the outer wall of magnet cover 136 and the inner surface of cylindrical wall 108.

The arrangement lends itself to automated mass manufacture and assembly and thus savings. This is because the fabrication sequence has fewer steps than that of the current commercially successful magnetic snaps.

It will be understood that various modifications may be made to the embodiments disclosed herein. Therefore, the above description should not be construed as limiting, but merely as exemplifications as preferred embodiments.

What is claimed is:

1. A magnetic closure device, which comprises:

(a) a magnetically attractive first element including:

i.) a cylindrical shaped magnet defining an axial bore and having first and second axial ends with first and second opposite polarities respectively;

ii.) an annular cover member covering said first axial end of said cylindrical magnet, said annular cover having a top plate, a side wall and an angled wall located at the junction of the top plate and the side wall to maintain the magnet in spaced relation relative to the side wall;

iii.) a ferromagnetic plate having a portion adjacent said second axial end of said cylindrical magnet; and b) a magnetically attractable second element positionable adjacent said annular cover member, said second element including a ferromagnetic protrusion centrally located thereon and extending substantially orthogonal thereto toward said first element, said protrusion configured and dimensioned to maintain a gap of no less than 0.005 millimeters between said first and second elements to prevent said elements from abrading one another during lateral movement when said elements are joined.

2. The magnetic closure device as recited in claim 1, wherein the average distance between said first and second axial ends is at least two millimeters, and wherein an outer peripheral surface of said magnet is defined by a side wall, and wherein said side wall is at least two millimeters in height.

3. The magnetic closure device as recited in claim 1, wherein the annular cover member is formed of non-ferromagnetic material.

4. The magnetic closure device as recited in claim 1, wherein the annular cover member has a flat upper surface which covers said first axial end of said magnet, and a peripheral wall portion monolithically formed therewith and disposed around said magnet to surround at least a portion of said side wall of said magnet.

5. The magnetic closure device as recited in claim 4, wherein the annular cover member has an angled or curved portion located at the joining of said peripheral wall and an outer edge of said flat upper surface of said annular cover member, wherein said angled or curved portion of said cover member maintains said magnet in a fixed location relative to said cover member.

6. The magnetic closure device as recited in claim 1, wherein the annular cover member defining an aperture therethrough, said aperture being smaller than said axial bore of said magnet, said aperture being aligned with and held in a fixed relationship with said axial bore of said magnet.

7. The magnetic closure device as recited in claim 1, wherein the ferromagnetic plate has a generally cylindrical wall portion monolithically formed therewith and disposed around said cylindrical shaped magnet, said cylindrical wall portion connected to said annular cover member and having a thickness substantially greater than the thickness of said annular cover member.

8. The magnetic closure device as recited in claim 1, wherein the magnetically attractable second element includes a second ferromagnetic plate positionable adjacent said annular cover member and said first axial end of said magnet, wherein the second ferromagnetic protrusion is fixedly attached to and extended downward from said second ferromagnetic plate, said second ferromagnetic protrusion being dimensioned to be positioned within and received by said aperture in said annular cover member and being spaced apart from an inner wall of said central axial bore of said magnet.

9. The magnetic closure device as recited in claim 1, further comprising a generally cylindrical wall portion disposed around said cylindrical shaped magnet and positioned between said ferromagnetic plate and said annular cover member.

10. The magnetic closure device as recited in claim 1, wherein an angle formed by the angled wall is in the range of approximately 3 degrees to approximately 90 degrees.

11. A magnetic closure device, which comprises:

a) a magnetically attractive first element including:

i.) a cylindrical shaped magnet defining an axial bore and having first and second axial ends with first and second opposite polarities respectively;

ii.) an annular cover member covering said first axial end of said cylindrical magnet;

iii.) a ferromagnetic plate having a portion adjacent said second axial end of said cylindrical magnet and a generally cylindrical wall portion attached thereto and disposed around said cylindrical shaped magnet and radially spaced a predetermined lateral distance therefrom, said cylindrical wall being placed adjacent said annular cover member and disposed around said cylindrical shaped magnet and having a textured surface which cooperates with a mating surface of the annular cover; and iv.) a ferromagnetic rod extending from said ferromagnetic plate into said axial bore of said cylindrical shaped magnet; and b) a magnetically attractable second element positionable adjacent said annular cover member, said second element including a ferromagnetic protrusion centrally located thereon and extending substantially orthogonal thereto toward said first element, said protrusion configured and dimensioned to maintain a gap of no less than 0.005 millimeters between said first and second elements to prevent said elements from abrading one another during lateral movement when said elements are joined.

12. A magnetic closure device, which comprises:

a) a magnetically attractive first element including:

i.) a cylindrical shaped magnet defining an axial bore and having first and second axial ends with first and second opposite polarities respectively;

ii.) an annular cover member covering said first axial end of said cylindrical magnet and having an aperture aligned with said bore of said magnet and of lesser dimension than said bore so as to define a rim portion extending into the area defined by said bore, said annular cover having a top plate, a side wall and an angled wall located at the junction of the top plate and the side wall to maintain the magnet in spaced relation relative to the side wall;

iii.) a ferromagnetic late having a portion adjacent said second axial end of said cylindrical magnet; and b) a magnetically attractable second element having a second ferromagnetic plate positionable adjacent said annular cover member and a central member extending therefrom and having a peripheral recess therein which defines a peripheral step thereon adjacent said rim portion, said central member being positionable within said bore and movable laterally therein such that said rim portion is engageable with said step to provide mechanical interference to prevent separation of said first and said second element by simultaneous lateral and axial movement of one from the other, said central member dimensioned to prevent said first and said second elements from abrading one another during lateral movement.

* * * * *